United States Patent [19]

Nishimura

[11] Patent Number: 4,586,191

[45] Date of Patent: Apr. 29, 1986

[54] SOUND SIGNAL PROCESSING APPARATUS

[75] Inventor: Satoshi Nishimura, Gifu, Japan

[73] Assignee: Sanyo Electric Co., Ltd., Japan

[21] Appl. No.: 406,442

[22] Filed: Aug. 9, 1982

[30] Foreign Application Priority Data

| | | | |
|---|---|---|---|
| Aug. 19, 1981 | [JP] | Japan | 56-129824 |
| Aug. 20, 1981 | [JP] | Japan | 56-130980 |
| Sep. 18, 1981 | [JP] | Japan | 56-148472 |
| Dec. 18, 1981 | [JP] | Japan | 56-205955 |

[51] Int. Cl.[4] ..... G10L 1/00

[52] U.S. Cl. ..... 381/31; 381/34

[58] Field of Search ..... 381/38, 29–40, 381/54; 360/8

[56] References Cited

U.S. PATENT DOCUMENTS

| | | | |
|---|---|---|---|
| 3,394,228 | 7/1968 | Flanagan et al. | 381/54 |
| 3,631,365 | 12/1971 | Dolby | 360/8 |
| 3,965,298 | 6/1976 | Carlson | 381/54 |
| 4,366,471 | 12/1982 | Kasuga | 381/34 |
| 4,462,555 | 8/1969 | Presti | 381/35 |

*Primary Examiner*—E. S. Matt Kemeny

*Attorney, Agent, or Firm*—Darby & Darby

[57] ABSTRACT

In a frequency conversion apparatus, the input signal is sampled and stored at one clock frequency, then read out at another clock rate and passed through a filter whose attenuation characteristics are a function of the second clock rate.

5 Claims, 17 Drawing Figures

FIG. 1 PRIOR ART
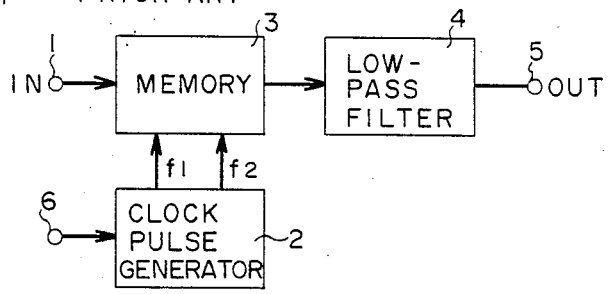
PRIOR ART
FIG. 2A
FIG. 2B
FIG. 2C
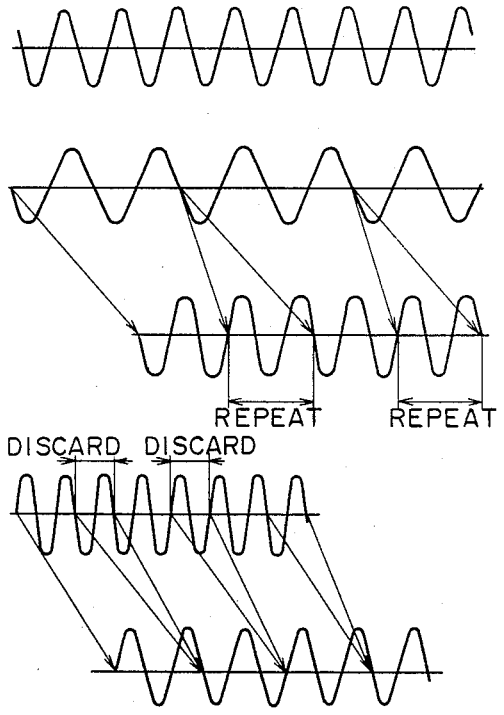
FIG. 2D
FIG. 2E

SOUND SIGNAL PROCESSING APPARATUS

BACKGROUND OF THE INVENTION

1. Field of the Invention

The present invention relates to a sound signal processing apparatus. More specifically, the present invention relates to an improvement in a sound signal processing apparatus wherein the ratio of the frequencies of a sampling pulse and a read clock pulse is made changeable and a sound signal is sampled as a function of the sampling pulse and the sampled data is stored in a memory and the data stored in the memory is read as a function of the read clock pulse, whereby the frequency of the sound signal is converted with the information maintained.

2. Description of the Prior Art

In recording and reproducing a sound signal using a recording medium such as a tape recorder, for example, it is often desired that the reproducing speed is different from the recording speed. In such a case, the frequency component of the sound signal as reproduced is varied as a function of the ratio Vp/Vr of the reproducing speed Vp and the recording speed Vr as a matter of course. More specifically, a frequency component x(f) of the sound signal becomes $Vp/Vr \cdot x\{(Vr/Vp)f\}$; however, when the ratio Vp/Vr becomes large, the sound signal becomes hard to understand or can hardly be understood, because of degraded articulation. Therefore, necessity arises in which the frequency of the sound signal remains unchanged, in other words, the pitch of the sound remains unchanged, even if the reproducing speed is changed so that the reproduction time may be prolonged or shortened. An apparatus for achieving the above described purpose has been proposed and is generally referred to as a time axis compressing/expanding apparatus. In such time axis compressing/expanding apparatus, the reproducing speed Vp and the recording speed Vr specifically mean the traveling speed (cm/sec) of a magnetic tape as for a tape recorder and the revolution number rpm of a record as for a disc record.

FIG. 1 is a block diagram for explaining the principle of correcting or changing the time axis. FIGS. 2A to 2E are graphs showing waveforms for the same purpose. Now the principle of correcting the time axis will be described. When an original signal shown in FIG. 2A is reproduced at a low speed by means of a tape recorder, a sound signal having the time axis changed as shown in FIG. 2B is obtained. When this sound signal as such is withdrawn, the sound is heard with a changed pitch and therefore in order to attain the same pitch, the time axis is compressed as shown in FIG. 2C while the same signal is partially repeated. To that end, a sound signal with the time axis changed is applied to an input terminal 1 and is sampled as a function of a sampling pulse of the frequency f1 obtained from a clock pulse generator, whereupon the sampled data is stored in a memory 3. The sampled data as stored undergoes repetitious reading of the same signal, in part, as a function of a read clock pulse of the frequency f2 obtained from the clock pulse generator 2, whereupon the read output is obtained from an output terminal 5 through a low-pass filter 4. Similarly, a sound signal as high speed reproduced as shown in FIG. 2D may be converted to a signal of the same frequency as the original signal by throwing away appropriate portions in the waveform shown in FIG. 2D and by connecting the waveforms by expanding the time axis as shown in FIG. 2E. In doing so, by selecting the ratio of the above described clock frequencies f1 and f2 to be equal to the reproducing speed ratio Vp/Vr, i.e., $$f1/f2 = Vp/Vr \quad (1)$$

the time axis of the sound signal at the input terminal 1 is corrected so that a reproducing signal having the same frequency component as that of the original signal is obtained at the output terminal 5. To that end, the speed ratio signal is supplied from the terminal 6 to the clock pulse generator 2 in order to produce the sampling pulse of the frequency f1 and the read clock pulse of the frequency f2 so as to meet the above described equation (1).

A circuit for storing the sampled data of the sound signal may comprise a bucket brigade device (or BBD), a charge coupled device (or CCD), an analog memory such as a capacitor memory, a digital memory such as a random access memory, or the like. Meanwhile, the low-pass filter 4 provided at the output of the FIG. 1 circuit serves to eliminate a high frequency signal component contained in a series of the sampled data, thereby to extract only a sound signal component.

On the other hand, according to the sampling theory, a desired reproducing signal frequency region is determined by the frequency f2 of the read clock and becomes lower than a half of the clock frequency f2. Therefore, in order to meet the above described equation (1), one might think of an approach in which the frequency f2 of the read clock pulse is set to a predetermined value in association with the frequency region of the reproducing signal while the frequency f1 of the sampling pulse is changed in association with the speed ratio signal. However, a problem arises as set forth in detail subsequently, when the frequency f1 of the sampling pulse is increased.

FIG. 3 is a block diagram showing an outline of a conventional time axis compressing/expanding circuit. FIGS. 4A, 4B and 4C are graphs showing spectrum distribution of a PCM signal in the sampled data series.

Now a structure and an operation of the time axis compressing/expanding circuit will be described. A sound signal is applied through an input terminal 1 to a low-pass filter 7. The low-pass filter 7 serves to restrict the frequency band of the applied sound signal. The sound signal which passed through the low-pass filter 7 is applied to an analog/digital converter 8. The analog/digital converter 8 is also connected to receive a sampling pulse from a clock pulse generator 21. The analog/digital converter 8 comprises a sample hold circuit so that the sound signal may be sampled to be converted into a digital signal, which is then applied to a random access memory 95. A clock pulse generator 21 may comprise a voltage controlled oscillator the oscillation frequency of which is changeable as a function of a voltage set by a variable resistor 11, for example. Meanwhile, the variable resistor 11 may be shared as a control voltage generator for generating a control voltage for controlling the speed of a reproducing motor 12 of a tape recorder, for example. The sampling pulse obtained from the clock pulse generator 21 is also applied to an address counter 91 and a read/write switch 93. The address counter 91 serves to designate the write address of the random access memory 95 and provides an address signal to a multiplexer 94. The read/write switch 93 serves to control a write or read operation of the random access memory 95. To that end, the read/-write switch 93 provides a read/write signal to the multiplexer 94 and random access memory 95. The multiplexer 94 provides an address signal from the address counter 91 to the random access memory 95 in the write mode. Accordingly, the random access memory 95 is stored with the sampled data obtained by sampling the sound signal by the analog/digital converter 8.

A clock pulse generator 22 at the read side serves to generate a read clock pulse having the fixed frequency f2 and the read clock pulse is applied to a digital/analog converter 10, an address counter 92, and a read/write switch 93. The address counter 92 serves to count the read clock pulse to designate the read address of the random access memory 95 and to that end the address signal is applied to the multiplexer 94. The read/write switch 93 provides a read control signal to the multiplexer 94 and the random access memory 95 in a read mode. Accordingly, the random access memory 95 is responsive to the read control signal and the read address signal to read the sampled data. The sampled data, as read, is applied to the digital/analog converter 10. The digital/analog converter 10 serves to convert the sampled data to an analog signal as a function of the read clock pulse. The analog signal is applied to a low-pass filter 4 for removal of a high frequency component and the output is obtained from the output terminal 5.

The above described time axis compressing/expanding circuit is adapted such that a control voltage is set by means of the variable resistor 11 so that the reproducing speed by the reproducing motor 12 may be the same as the recording speed, the frequency f1 of the sampling pulse obtained from the clock pulse generator 21 may be equal to the frequency f2 of the read clock obtained from the clock pulse generator 22 as a function of the above described control voltage, and various characteristics are set so that the speed variation of the reproducing motor 12 with respect to the above described control voltage may be always equal to the variation of the frequency f1 of the sampling pulse. Then, it follows that the previously described equation (1) is met with respect to the frequency f1 of the sampling pulse and the frequency f2 of the read clock pulse, so that a desired time axis compression/expansion processing with the frequency of the sound signal unchanged can be achieved. In this case, $f1>f2$ is established on the occasion of high speed reproduction. Accordingly, it would be appreciated that by selecting of number of data storing regions (the sample number) in the random access memory 95 to be N, the samples of $N(1-f2/f1)$ is disregarded without being read at each cycle in N samples as read in these storing regions, with the result that the frequency of the residual data is as high as (f2/f1) times. Furthermore, since $f1<f2$ on the occasion of low speed reproduction, likewise the samples of the number $N(1-f1/f2)$ are repeatedly read out and the frequency of them becomes as high as (f2/f1) times.

Meanwhile, the spectrum structure of the sampled data time sequence as sampled in accordance with the write clock of the frequency f1 has approximately the same spectrum distribution as that of the input signal at both sides an integer number times the sampling frequency f1 as shown in FIG. 4A. Accordingly, when the frequency band restriction of the input signal is incomplete, an overlapping occurs between the spectrum of the input signal and the spectrum of the integer times the sampling frequency (1), as shown by the dotted line in FIG. 4A. Such overlapping which once occurred through such sampling is unseparable and distortion referred to as a folded noise occurs due to the above described overlapping. The low-pass filter 7 shown in FIG. 3 is provided for the purpose of eliminating this folded noise and the same must have a characteristic of sufficient attenuation at the frequency ratio (f1/2).

Meanwhile, the input signal has a frequency width changeable as a function of the reproduction speed ratio as shown in FIGS. 4B and 4C depending on the high speed reproduction or the low speed reproduction. Simultaneously the frequency f1 of the sampling clock is also changeable. Accordingly, in order to completely eliminate the folded noise in the case where the spectrum structure is changeable, it is necessary to select the frequency f1 of the sampling clock to be sufficiently large or to change the frequency width of the low-pass filter 7 at the input side in association with the reproduction speed ratio (Vr/Vp). However, generally, when the frequency f1 of the sampling clock is increased, the storage capacity (N) at the random access memory 95 need be accordingly increased. Therefore, this is much less utilized from the standpoint of cost and more often the characteristic of the low-pass filter 7 at the input side is normally changed. Therefore, a voltage control variable attenuation characteristic filter exhibiting an attenuation characteristic changeable as a function of a speed control voltage is utilized as the low-pass filter 7 shown in FIG. 3.

Although the time axis compressing/expanding circuit shown in FIG. 3 was structured such that a sound signal as reproduced at low speed or high speed and received as an input signal is converted to a signal of the same frequency as that of the original signal, an occasion could arise in which it is desired such as in the case of an electronic musical instrument that the frequency of a musical signal is converted to a different pitch. Even in such a case, the inputted musical signal is sampled as a function of the sampling pulse and the sampled data is stored, whereupon the data is read as a function of the read clock pulse. However, in the case where the pitch of the output signal is to be thus changed, the frequency width of the inputted musical signal is fixed while the frequency width of the outputted musical signal is variable and therefore the time axis compressing/expanding circuit shown in FIG. 3 as such can not be utilized. More specifically, in applying the musical signal as low speed reproduced or high speed reproduced, it is necessary to restrict the frequency width of the input signal; however, in the case where the pitch of the musical signal to be outputted is to be changed, it is necessary to restrict the frequency width of the output signal or to increase the frequency f2 of the read clock pulse.

SUMMARY OF THE INVENTION

The present invention provides a sound signal processing apparatus which is capable of changing the pitch of an inputted sound signal arbitrarily and capable of providing a sound signal of a changed pitch.

Briefly described, the present invention comprises first clock pulse generating means for generating a first clock pulse serving as a sampling pulse, second clock pulse generating means for generating a second clock pulse serving as a read clock pulse, first and second filter means provided at the input end and the output end, respectively, and frequency converting means. The first filter means has a fixed attenuation characteristic and receives the inputted sound signal and provides the output to the frequency converting means. The frequency converting means serves to sample the sound signal as a function of the first clock pulse and store the same and reads the stored data as a function of the second clock pulse the frequency of which is changeable in response to an external control signal. The read signal is applied to the second filter means the attenuation characteristic of which is changeable in association with the conversion of the frequency of the second clock pulse.

Therefore, according to the present invention, a sound signal of a changed pitch is obtained by changing the frequency of the second clock pulse. Furthermore, since the attenuation characteristic of the second filter means is changed in association with the conversion of the frequency of the second clock pulse, the frequency band of the sound signal thus obtained can be restricted and therefore folded (foldover) noise can be eliminated without increasing the frequency of the first clock pulse, i.e. the sampling pulse.

In a preferred embodiment of the present invention, the first clock pulse generating means and the second clock pulse generating means are switchably coupled to the input and output ends of the frequency converting means by means of the first switching means, and the first filter means and the second filter means are switchably coupled to the input and output ends of the frequency converting means by means of the second switching means. When the first and second switching means are set to a first state, the sound signal obtained from the first filter means is sampled as a function of the first clock pulse and the sampled data is stored and the stored data is read as a function of the second clock pulse and is obtained from the second filter means. As a result, a sound signal of the changed pitch can be obtained. Conversely, when the first and second switching means are set to a second state, the sound signal obtained from the second filter means is sampled as a function of the second clock pulse and the sampled data is stored and the stored data is read as a function of the first clock pulse and is obtained from the first filter means. As a result, the sound signal as low speed reproduced or high speed reproduced having the same frequency as that of the original signal can be obtained. Therefore, according to the above described preferred embodiment, the pitch of the inputted sound signal can be changed or the sound signal as low speed reproduced or high speed reproduced can be changed to a sound signal of the same frequency as that of the original signal using a common circuit.

In a further preferred embodiment of the present invention, a control signal is generated in response to the inputted sound signal and a reference sound signal. Then the frequency of the first clock pulse is changed and the attenuation characteristic of the second filter means is changed as a function of the control signal, whereby the inputted sound signal is converted to a sound signal of the pitch consistent with that of the reference sound signal.

Therefore, by applying the above described embodiment to an electronic musical instrument, a musical signal of a different pitch can be converted into a musical signal of a pitch consistent with that of a reference musical signal.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a block diagram for explaining the principle of correction of the time axis;

FIGS. 2A to 2E are graphs showing waveforms for explaining the principle of correction of the time axis;

DESCRIPTION OF THE PREFERRED EMBODIMENTS

Figure 5:
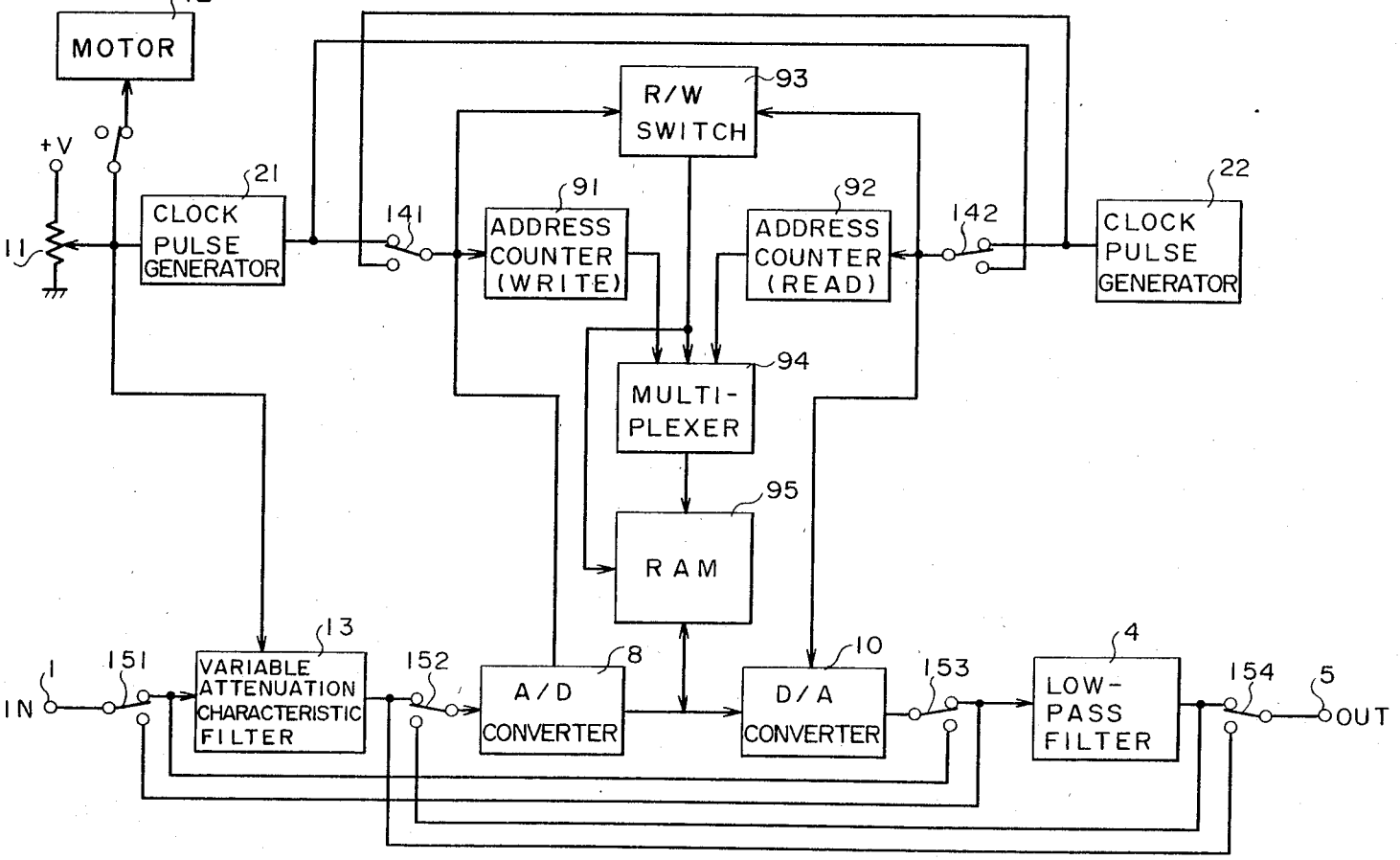
FIG. 5 is a block diagram of an outline of one embodiment of the present invention.
Figure 6:
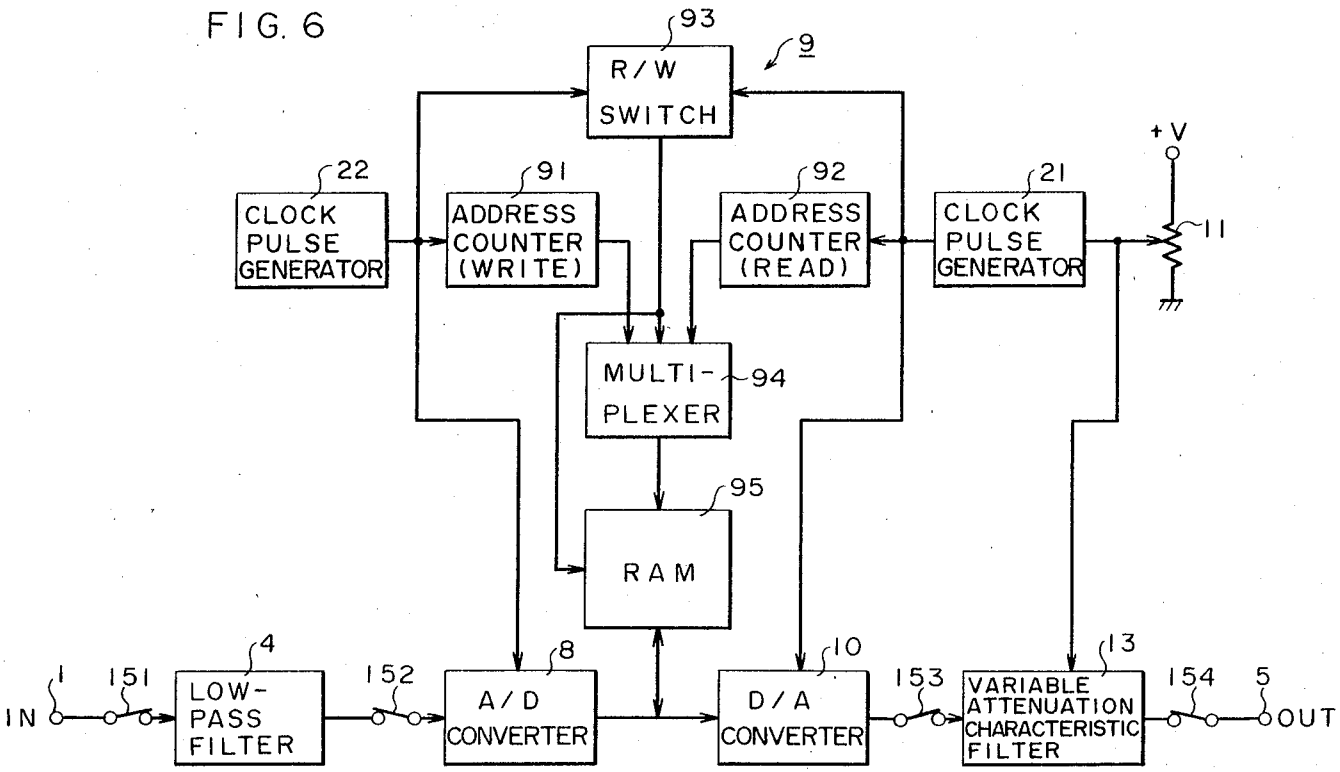
FIG. 6 is a block diagram of the FIG. 5 embodiment when a selection switch is turned.
Figure 7:
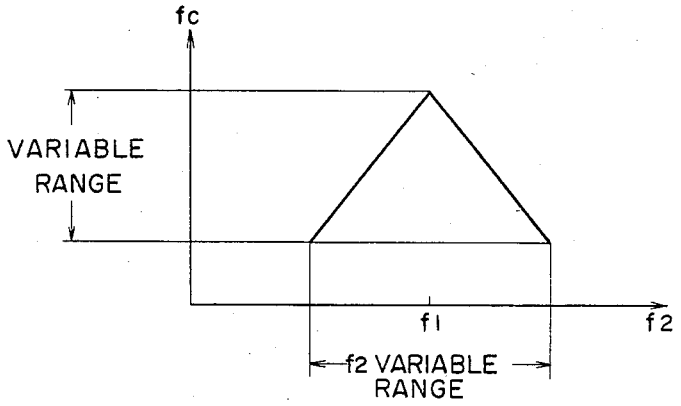
FIG. 7 is a graph showing a characteristic of variable attenuation characteristic filter shown in FIGS. 5 and 6.

FIG. 5 is a block diagram of an outline of one embodiment of the present invention. FIG. 6 is a block diagram of the FIG. 5 embodiment when selecting switches 141, 142, 151 to 154 are turned to a first state. FIG. 7 is a graph showing a characteristic of a variable attenuation characteristic filter 13 shown in FIGS. 5 and 6. First referring to FIG. 5, a structure of one embodiment of the present invention will be described. The FIG. 5 block diagram is substantially the same as the FIG. 3 block diagram, except for the following respects. More specifically, the selecting switches 141 and 142 serving as a first selecting means are provided between a clock pulse generator 21 serving as a second clock pulse generating means at the input end and an address counter 91, and between a clock pulse generator 22 serving as a first clock pulse generating means at the output end and an address counter 92. These selecting switches 141 and 142 serve to provide the clock pulses obtained from the clock pulse generator 21 and 22 to the input and output ends of the frequency converter 9. More specifically, if and when the selecting switches 141 and 142 are turned to a second state as shown in FIG. 5, the clock pulse obtained from the clock pulse generator 21 is applied to an address counter 91 as a sampling pulse and the clock pulse obtained from the clock pulse generator 22 at the output end is applied to an address counter 92 as a read clock pulse. Conversely, if and when the selecting switches 141 and 142 are simultaneously turned, the clock pulse obtained from the clock pulse generator 21 at the input end is applied to an address counter 92 as a read clock pulse and the clock pulse obtained from the clock pulse generator 22 at the output end is applied to an address counter 91 as a sampling pulse.

Furthermore, selecting switches 151 to 154 serving as a second selecting means are provided for switching a variable attenuation characteristic filter 13 serving as a second filter means and a low-pass filter serving as a first filter means to the input or the output. More specifically, the selecting switch 151 serves to provide the sound signal applied to the input terminal 1 to the variable attenuation characteristic filter 13 or the low-pass filter 4. The selection switch 152 serves to provide the output of the variable attenuation characteristic filter 13 to the analog/digital converter 8 or the output terminal 5. The selection switch 153 serves to provide the output of the digital/analog converter 10 to the low-pass filter 4 or the variable attenuation characteristic filter 13. The selection switch 154 serves to provide the output of the low-pass filter 4 to the output terminal 5 or the analog/-digital converter 8. Meanwhile, the variable attenuation characteristic filter 13 is structured to exhibit a cutoff characteristic which is changeable as a function of a control voltage Vc obtained by manually operating a variable resistor 11. Assuming the cutoff frequency of the variable attenuation characteristic filter 13 to be fc, then the following relation is established:

$$f1 = k1 \cdot Vc \quad (2)$$

$$f2 = k2 \cdot Vc \quad (3)$$

where k1 and k2 are constants. The control voltage Vc is given as a speed control voltage of the reproducing motor 12 through the switch 27. Accordingly, the speed Vp of the reproducing motor 12 is given by the following equation (4):

$$Vp = k3 \cdot Vc \quad (4)$$

where k3 is a constant. Meanwhile, the attenuation characteristic of the low-pass filter 4 at the output end has a sufficient attenuation amount at the half of the frequency f2 of the clock pulse obtained from the clock pulse generator 22.

If and when the selection switches 141, 142, 151 to 154 are simultaneously turned in the above described sound signal processing apparatus, then the FIG. 5 block diagram becomes as shown in FIG. 6. More specifically, the sound signal applied to the input terminal 1 is applied to the analog/digital converter 8 through the selection switch 151, the low-pass filter 4 and the selection switch 152. The analog/digital converter 8 serves to sample the sound signal as a function of the clock pulse of the frequency f2 obtained from the clock pulse generator 22 and the sampled data as digital coded is stored in the address of the random access memory 95 designated by the address counter 91.

The sampled data as stored in the random access memory 95 is read out as a function of the clock pulse of the frequency of f1 obtained from the clock pulse generator 21. However, the frequency f1 of the clock pulse is determined as a function of a control voltage determined at an adjusting position of the variable resistor 11. The data as read out as a function of the clock pulse is converted into an analog format by means of the digital-/analog converter 10 and is obtained through the selection switch 153, the variable attenuation characteristic filter 13 and the selection switch 154 from the output terminal 5. The frequency conversion ratio (i.e. the pitch conversion ratio in this case) becomes the ratio f1/f2 of the frequency f1 of the sampling clock and the frequency f2 of the read clock and therefore, by properly adjusting the variable resistor 11, the pitch of the sound signal thus obtained can be arbitrarily changed. The cutoff frequency fc of the variable attenuation characteristic filter 13 is changed in association with the frequency f1 of the read clock pulse as a function of the control voltage Vc as shown by the previously described equations (2) and (3). More specifically, since the variable attenuation characteristic filter 13 exhibits a sufficient attenuation amount at approximately a half of the frequency f1 of the read clock pulse as shown in FIG. 7, a portion of the read clock pulse component entering into the frequeny band of the output signal can be disregarded.

Figure 3:
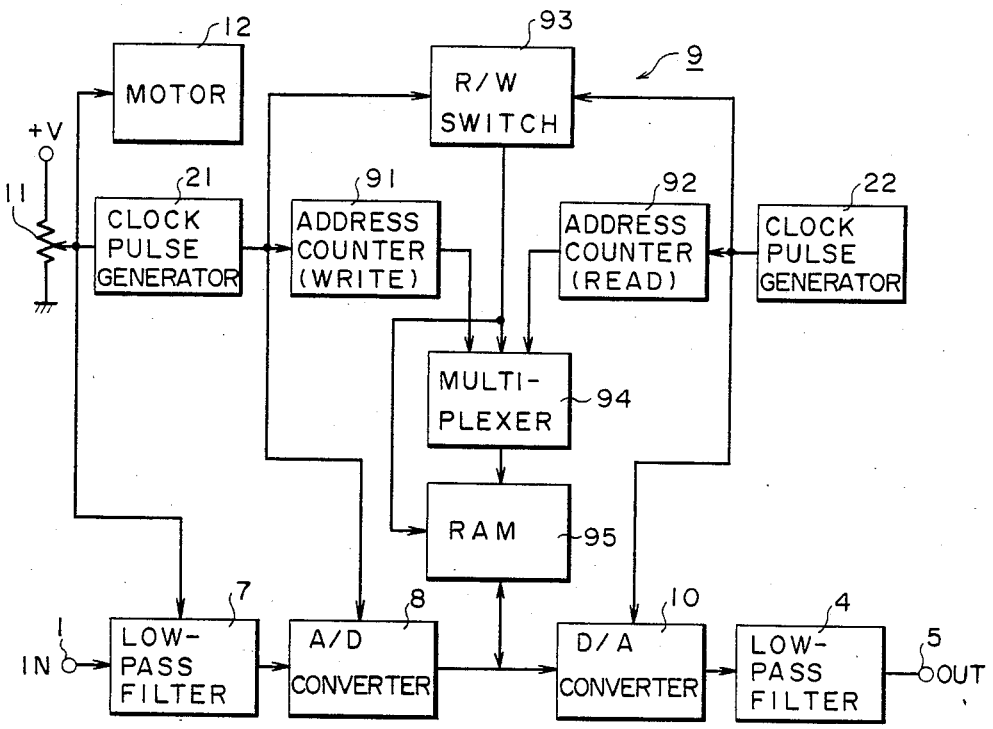
FIG. 3 PRIOR ART
FIG. 3 is a block diagram of an outline of a conventional time axis compressing/expanding circuit.
Figure 4A:
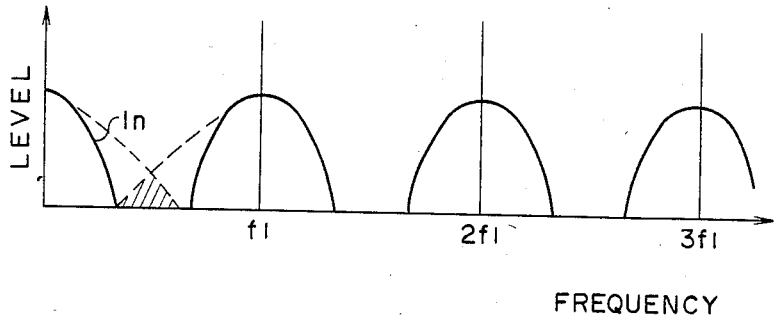
FIG. 4A PRIOR ART
FIGS. 4A, 4B and 4C are graphs showing spectrum distributions of a PCM signal in a sampled value time sequence.
Figure 4B:
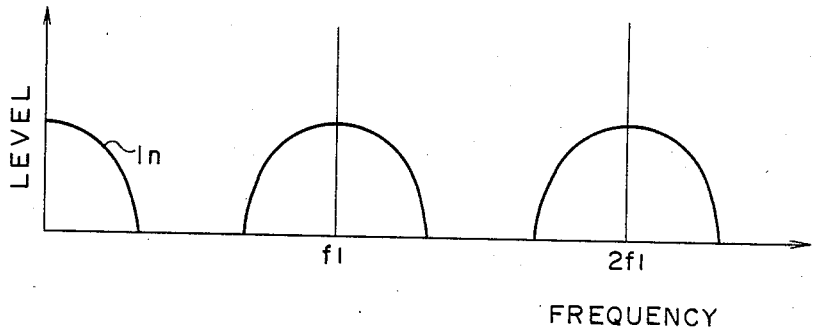
FIG. 4B PRIOR ART
Figure 4C:
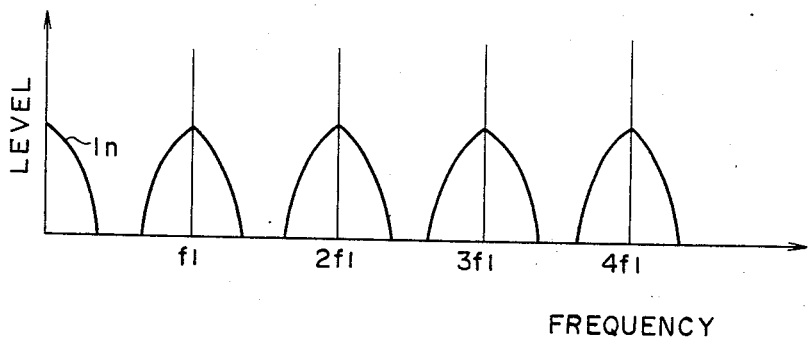
FIG. 4C PRIOR ART

On the other hand, by turning the selection switches 141, 142, 151 to 154 to the second state as shown in FIG. 5, substantially the same structure as shown in FIG. 3 is established. In such a case, the variable attenuation characteristic filter 13 is connected to the input end. Therefore, even if the sound signal as low speed reproduced or high speed reproduced from a tape recorder is inputted, the frequency band restriction is made in association with the respective frequency bands. Accordingly, the frequency of the sound signal as low speed reproduced or high speed reproduced obtained from the low-pass filter 4 of the output end is converted, whereby the original signal is obtained.

As described in the foregoing, the embodiment shown was structured such that the variable attenuation characteristic filter 13 having an attenuation characteristic changeable in association with the frequencies obtained from the clock pulse generator 21 of a variable frequency and the clock pulse generator 22 and the clock pulse generator 21 of the fixed frequencies and the low-pass filter 4 having the fixed attenuation characteristic are turned to the input or the output of the frequency converter 9 by means of the selection switches 141, 142, 151 to 154. Therefore, the pitch of the sound signal as inputted can be changed arbitrarily or the sound signal as low speed reproduced or high speed reproduced can be obtained with a sound signal of a reference pitch using the same circuit configuration.

Figure 9:
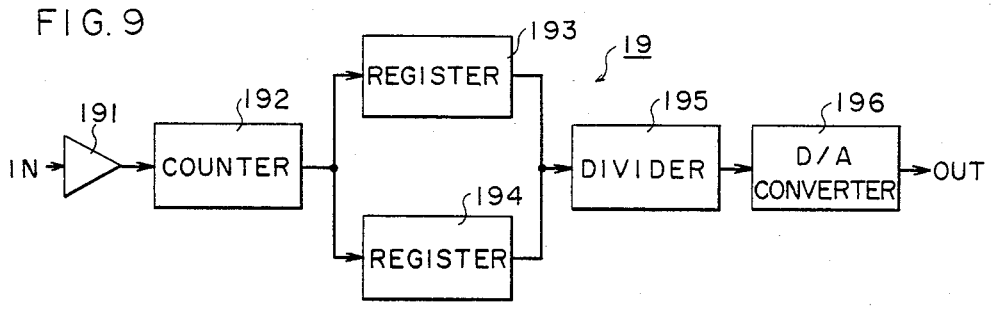
FIG. 9 is a block diagram showing in more detail a conversion ratio detecting circuit shown in FIG. 8.
Figure 8:
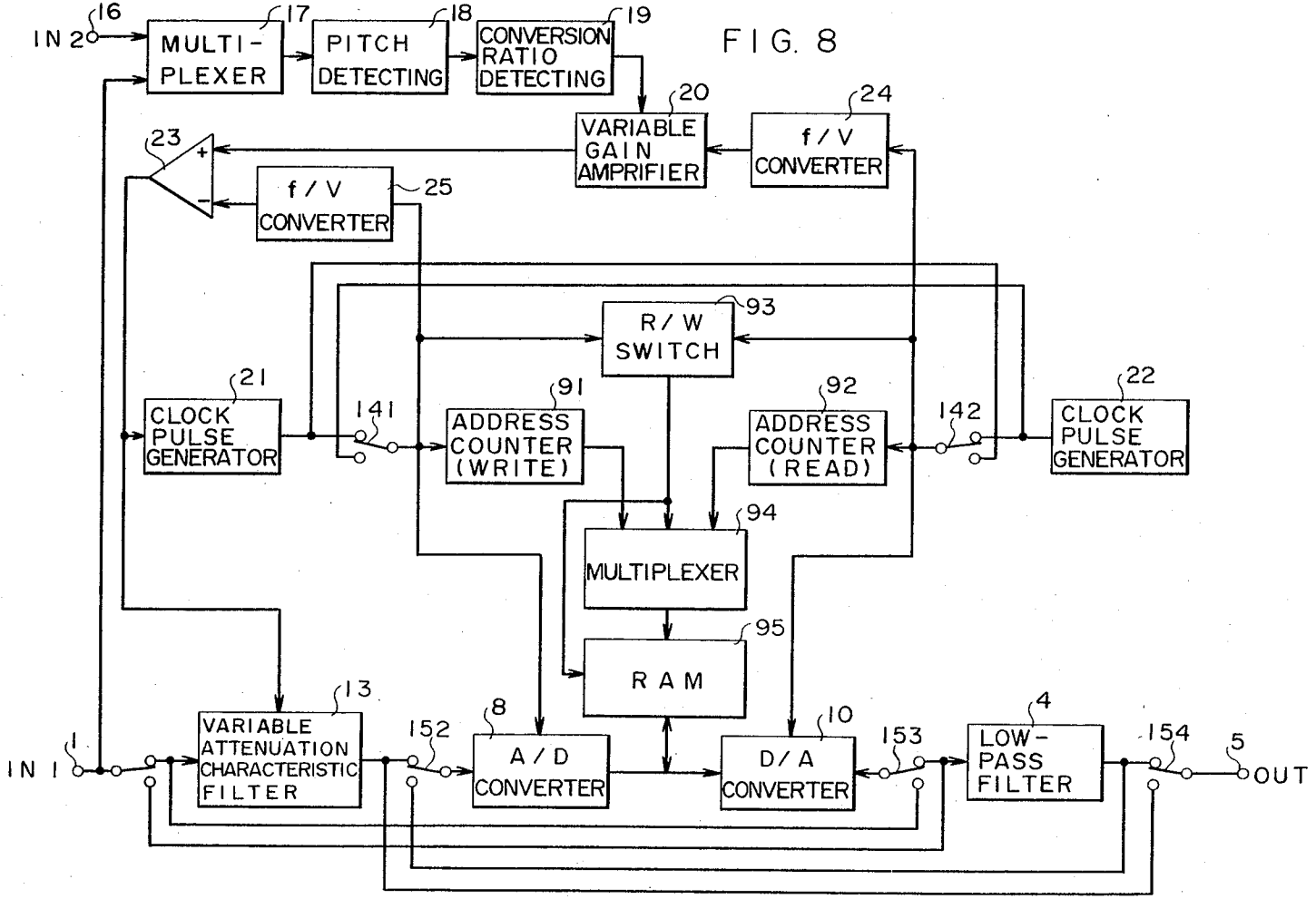
FIG. 8 is a block diagram of an outline of another embodiment of the present invention.

FIG. 8 is a block diagram of an outline of another embodiment of the present invention and FIG. 9 is a block diagram of the conversion ratio detecting circuit 19 shown in FIG. 8. The embodiment shown in FIGS. 8 and 9 is adapted such that the pitch of the sound signal inputted to the input terminal 1 is tuned to the pitch of a reference sound signal inputted to the input terminal 16. More specifically, the sound signal inputted to the input terminal 1 and the reference sound signal inputted to the input terminal 16 are applied to the multiplexer 17. The multiplexer 17 serves to provide sound piece elements by alternately switching the respective sound signals at appropriate time intervals of say several hundreds msec. The sound piece elements are then applied to the pitch detecting circuit 18. The pitch detecting circuit 18 serves to detect the respective fundamental pitch frequencies of the sound piece elements obtained from the multiplexer 17. By the fundamental pitch frequency, is meant the lowest frequency out of the frequency peaks appearing in the sound or musical signal frequency spectrum. The detected fundamental pitch frequency is applied to the conversion ratio detecting circuit 19. The conversion ratio detecting circuit 19 is responsive to the respective fundamental pitch frequencies of the two sound signals to detect the ratio T2/T1 of the respective pitch periods T1 and T2. As shown in FIG. 9, the conversion ratio detecting circuit 19 comprises a comparator 191, a counter 192, resistors 193 and 194, a divider 195, and a digital/analog converter 196. More specifically, the comparator 191 serves to pulse shape the output of the pitch detector 17 shown in FIG. 8. The counter 192 serves to count the period T1 or T2 of the output pulse obtained from the comparator 191. The registers 193 and 194 serves to store the count value in the counter 192 alternately in synchronism with the selecting timing of the multiplexer 17 alternately switching the sound signal and the reference sound signal. The divider 195 serves to operate the ratio of the pitch periods based on the fundamental pitch periods T1 and T2 stored in the registers 193 and 194, respectively. Furthermore, the digital/analog converter 196 serves to provide the ratio of the pitch periods of the output from the divider 195 as an analog signal.

The analog signal obtained from the above described conversion ratio detecting circuit 19 is applied to the variable gain amplifier 20 as a control signal. On the other hand, the frequency f1 of the clock pulse obtained from the clock pulse generator 22 is converted to a voltage value by means of the f/V converter 24 and the output is applied to the variable gain amplifier 20. The variable gain amplifier 20 serves to control the gain of the applied voltage as a function of the ratio of the pitch periods, thereby to provide the output signal to the positive input terminal of the error amplifier 23. The frequency f2 of the clock pulse obtained from the clock pulse generator 21 is converted to a voltage value by means of the f/V converter 25 and the output is applied to the negative input of the error amplifier 23. Accordingly, the error amplifier 23 serves to provide a control voltage based on an error of the applied two voltage values. The control voltage is applied to the clock pulse generator 21 and the variable attenuation characteristic filter 13. By thus, structuring the sound signal processing apparatus, the sound signal applied to the input terminal 1 can be tuned to the pitch of the reference sound signal applied to the input terminal 16. More specifically, the sound signal applied to the input terminal 1 is applied through the low-pass filter 4 to the analog/digital converter 8. The output of the analog/-digital converter 8 is sampled as a function of the clock pulse of the frequency f1 obtained from the clock pulse generator 22 and the sampled data is stored in the random access memory 95. This series of operations is the same as that of the FIG. 6 embodiment.

On the other hand, the sound signal and the reference sound signal are in succession switched by means of the multiplexer 17 and the output is applied to the pitch detecting circuit 18, whereby the fundamental pitch frequencies of the respective sound signals are detected. Then the ratio m of the fundamental pitch periods T1 and T2 of the respective sound signals are operated by the conversion ratio detecting circuit 19 and the gain of the variable gain amplifier 22 is determined by the above described ratio m. On the other hand, the voltage V1 corresponding to the frequency f1 of the clock pulse obtained from the f/V converter 24 is applied to the variable gain amplifier 20. Accordingly, the variable gain amplifier 20 provides the output voltage of mV1 to the error amplifier 23. Furthermore, the voltage V2 corresponding to the frequency f2 of the clock pulse is obtained from the f/V converter 25 and is applied to the error amplifier 23. Accordingly, the voltage vm is obtained from the error amplifier 23 so that mV1=V2 may be established, whereupon the voltage vm is applied to the clock pulse generator 21 and the variable attenuation characteristic filter 13. Accordingly, the clock pulse generator 21 generates a clock pulse of the frequency of f2=mf1. The sampled data stored in the random access memory 95 is read as a function of the above described clock pulse. The sampled data is withdrawn from the output terminal 5 through the variable attenuation characteristic filter 13 the frequency band of which is restricted as a function of the voltage vm. Therefore, according to the embodiment, frequency conversion of f2/f1=1/m is performed by the frequency converter 9. More specifically, the frequency of the sound signal applied to the input terminal 1 becomes 1/m times the output at terminal 5. However, the sound signal applied to the input terminal 1 has the fundamental pitch m=T2/T1 as compared with the sound signal applied to the input terminal 16 and therefore the fundamental pitch frequency of the sound signal obtained from the output terminal 5 is consistent with the fundamental pitch frequency of the reference sound signal.

Meanwhile, even in the case where the pitch of the inputted sound signal is to be changed, it is necessary to partially disregard or repeat the sampled data stored in the random access memory 95 in reading the same. At that time, it is necessary to control the read address of the random access memory 95 in connecting the sound piece elements so that discontinuity may not arise in the output signal waveform. To that end, it is a common practice to employ a microcomputer programmed to control the read address based on the calculated result obtained by calculating the mutual correlation at the connecting portions of the waveforms. In such a case, the positions of discontinuity of the read data are determined as a function of the frequency f1 of the sampling pulse, the frequency f2 of the read clock pulse and the storage capacity N of the random access memory 95 and these values can be known in advance. The data Xp at the trailing edge of the preceding sound piece element and the data Yp of the leading edge of succeeding sound piece element with respect to the discontinuity portion of the respective sound piece elements are subjected to the following calculation:

$$e_k = \sum_{P=0}^{M-1} |X_p - Y_p + k|$$

where p=0, 1, 2 . . . M−1, k=0, 1, 2 . . . , R−1, whereupon k is evaluated for the minimum ek, whereby the read address is controlled in association with k when the read address approaches the discontinuity point or the vicinity thereof. By doing so, the sound piece elements can be connected without any discontinuity of the pitch frequencies of the resulting waveform.

Figure 10:
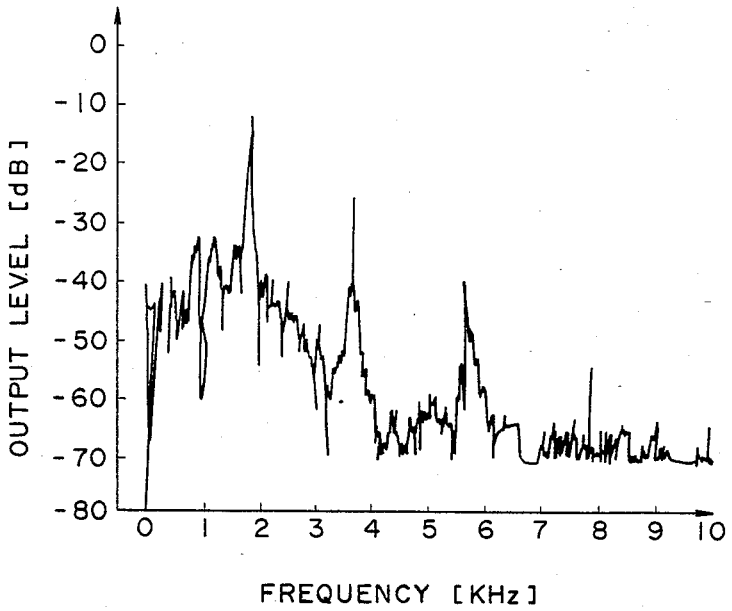
FIG. 10 is a graph showing a spectrum at the instant when a key of a piano is depressed.

However, generally, the spectrum of the sound signal including a musical signal includes a plurality of resonance frequencies as shown in an instantaneous spectrum of a piano tone in FIG. 10, for example, and therefore a complete sound signal cannot be reproduced by a conventional pitch connection by means of a single frequency converting circuit. More specifically, by making pitch connection with respect to a low frequency component, a high frequency component cannot be connected and vice versa. Therefore, it is necessary to split the inputted sound signal into a predetermined frequency regions, to make frequency conversion of the sound signal for each of the frequency regions as split, and then to synthesize the respective sound signals.

Figure 11:
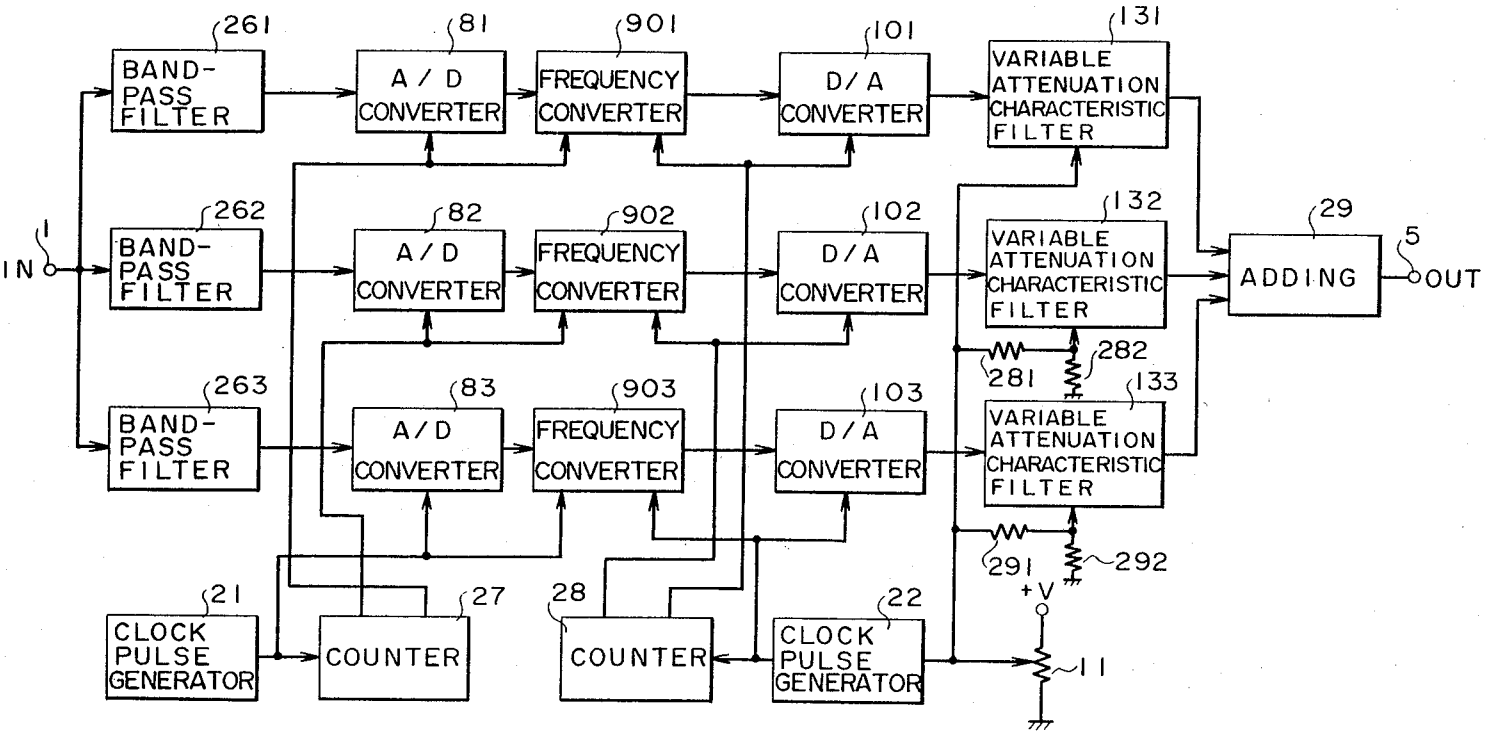
FIG. 11 is a block diagram of an outline of a further embodiment of the present invention.

FIG. 11 is a block diagram of an embodiment for performing such sound signal processing. First, the structure of the embodiment will be described. The sound signal applied to the input terminal 1 is applied to the bandpass filters 261 to 263. The bandpass filter 261 serves to extract the sound signal included in a predetermined frequency band width of the center frequency of a. The bandpass filter 262 serves to extract the sound signal included in a predetermined frequency band of the center frequency of 2*a*. The bandpass filter 263 serves to extract the sound signal included in a predetermined frequency band of the center frequency of 4*a*. The output of the bandpass filter 261 is applied to the analog/digital converter 81, the output of the bandpass filter 262 is applied to the analog/digital converter 82, and the output of the bandpass filter 263 is applied to the analog/digital converter 83. The clock pulse of the frequency 4f1 obtained from the clock generator 21 is applied to the analog/digital converter 83 and the frequency converter 903. The clock pulse is applied to the counter 27, whereby the frequency is divided by two and four. The clock pulse of the frequency 2f1 as frequency divided by two is applied to the analog/digital converter 82 and the frequency converter 902. The clock pulse of the frequency f1 as frequency divided by four is applied to the analog/digital converter 81 and the frequency converter 901. Meanwhile, the frequency converters 901 to 903 are structured in substantially the same manner as that of the frequency converter 9. Accordingly, the sound signal of the frequency band with the center frequency a is sampled as a function of the clock pulse of the frequency f1 and the sampled data is stored in the frequency converter 901. The sound signal of the frequency band with the center frequency 2*a* is sampled by the analog/digital converter 82 as a function of the clock pulse of the frequency 2f1 and the sampled data is stored in the frequency converter 902. Furthermore, the sound signal of the frequency band with the center frequency of 4*a* is sampled by the analog/digital converter 83 as a function of the clock pulse of the frequency 4f1.

The clock pulse of the frequency 4f2 obtained from the clock generator 22 at the output end is applied to the above described frequency converter 903 and the digital/analog converter 103. The above described clock pulse is also applied to the counter 28 so that the same is frequency divided by two and four. The clock pulse of the frequency 2f2 as frequency divided by two is applied to the frequency converter 902 and the digital-/analog converter 102. The clock pulse of the frequency f2 as frequency divided by four is applied to the frequency converter 901 and the digital/analog converter 101. Accordingly, the sampled data stored in the frequency converter 901 is read as a function of the clock pulse of the frequency f2 and is converted into an analog signal by means of the digital/analog converter 101. The sampled data stored in the frequency converter 902 is read as a function of the clock pulse of the frequency 2f2 and is converted into the analog signal by means of the digital/analog converter 102. Furthermore, the sampled data stored in the frequency converter 903 is read as a function of the clock pulse of the frequency 4f2 and is converted into the analog signal by means of the digital/analog converter 103. Furthermore, the voltage as set by the variable resistor 11 for controlling the oscillation frequency of the clock pulse generator 22 is applied to the variable attenuation characteristic filter 131. The voltage is voltage divided by the resistors 281 and 282 and the divided voltage is applied to the variable attenuation characteristic filter 132 as a voltage corresponding to the frequency 2f2 of the read clock. Furthermore, the voltage set by the variable resistor 11 is voltage divided by the resistors 291 and 292 and the divided voltage is applied to the variable attenuation characteristic filter 133 as a voltage corresponding to the frequency 4f2 of the clock pulse. Accordingly, the variable attenuation characteristic filter 131 comes to exhibit an attenuation characteristic corresponding to the voltage set by the variable resistor 11 and the analog signal obtained from the digital-/analog converter 101 is applied to the adding circuit 29. Similarly, the variable attenuation characteristic filter 132 comes to exhibit an attenuation characteristic corresponding to the clock pulse of the frequency 2f2 and the analog signal obtained from the digital/analog converter 102 is applied to the adding circuit 29. Furthermore, the variable attenuation characteristic filter 133 comes to exhibit an attenuation characteristic corresponding to the clock pulse of the frequency 4f2 and the analog signal obtained from the digital/analog converter 103 is applied to the adding circuit 29. The adding circuit 29 sums up the sound signals as frequency converted for the respective frequency regions, thereby to provide a summed up output at the output terminal 5.

As described in the foregoing, according to the present embodiment shown, the sound signals are sampled and stored for the respective frequency regions as split and the sampled data as stored is read for the respective frequency regions as a function of the corresponding read clock pulses, whereupon the outputs are applied to the filters exhibiting the attenuation characteristics associated with the read clock pulses and the outputs are synthesized. Therefore, the waveform connection processing of the sound piece elements can be done for each of the frequency regions as split by means of each of the frequency converters 901 to 903. Accordingly, pitch connection processing can also be done for each of the respective frequency spectrums.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sound signal processing apparatus for converting the frequency of a sound signal, comprising:

an input terminal for receiving said sound signal, first clock pulse generating means for generating a first clock pulse having a fixed frequency, second clock pulse generating means for generating a second clock pulse having a frequency variable as function of a given external control signal, first filter means receiving said sound signal applied to said input terminal and having a fixed attenuation characteristic, frequency converting means responsive to the output of said first clock pulse generating means for sampling the output of said first filter means, for storing said sampled data, responsive to the output of said second clock pulse generating means for reading said sampled data as stored for providing said sound signal of a converted frequency, second filter means receiving the output of said frequency converting means having an attenuation characteristic changeable as a function of the change of the frequency of said second clock pulse, and an output terminal coupled to said second filter means for providing an output signal therefrom, wherein said frequency converting means comprises a sampling pulse input terminal for receiving as a sampling pulse one of the output of said first clock pulse generating means and the output of said second clock pulse generating means, a read clock pulse input terminal for receiving as a read clock pulse the other of the output of said first clock pulse generating means and the output of said second clock pulse generating means, a sound signal input terminal for receiving said sound signal, and a sampled data output terminal for providing said sampled data, first switching means for connecting one of the output of said first clock pulse generating means and the output of said second clock pulse generating means to the sampling pulse input terminal of said frequency converting means and for connecting the other of the output of said first clock pulse generating means and the output of said second clock pulse generating means to the read clock pulse input terminal of said frequency converting means, and second switching means for connecting one of the output of said first filter means and the output of said second filter means to the sound signal input terminal of said frequency converting means and for connecting the other of the output of said first filter means and the output of said second filter means to the sampled data output terminal of said frequency converting means and for connecting the output of either said filter means connected to said sampled data input terminal to said output terminal, and wherein said first and second switching means, in a first state, supplying the output of said first clock pulse generating means to the sampling pulse input terminal of said frequency converting means and the output of said second clock pulse generating means to the read clock pulse input terminal of said frequency converting means and supplying the sound signal from said input terminal to the input of said first filter means and the output of said first filter means to the sound signal input terminal of said frequency converting means and supplying the sampled data from said frequency converting means to the input of said second filter means and supplying the output of said second filter means to said output terminal, said first and second switching means, in a second state, supplying the output of said second clock pulse generating means to the sampling pulse input terminal of said frequency converting means and the output of said first clock pulse generating means to the read clock pulse input terminal of said frequency converting means, supplying the sound signal from said input terminal to the input of said second filter means, supplying the output of said second filter means to the sound signal input terminal of said frequency converting means, supplying the output of said frequency converting means to the input of said first filter means, and supplying the output of said first filter means to said output terminal.

2. A sound signal processing apparatus in accordance with claim 1, wherein said second filter means comprises means for changing the attenuation characteristic in association with the difference of the frequencies of the output of said first clock pulse generating means and the output of said second clock pulse generating means.

3. A sound signal processing apparatus in accordance with claim 1, wherein said sound signal comprises fundamental pitch frequency components, and which further comprises a reference sound signal input terminal for receiving a reference signal including a fundamental pitch frequency component which is different from a fundamental pitch frequency component of said sound signal, and control signal output means responsive to said sound signal and said reference sound signal for providing a control signal for changing the frequency of the output of said second clock pulse generating means, and wherein said frequency converting means comprises means responsive to the output of said second clock pulse generating means for making consistent the fundamental pitch frequency of said sound signal with the fundamental pitch frequency of said reference sound signal.

4. A sound signal processing apparatus in accordance with claim 3, wherein said control signal generating means comprises means for detecting the fundamental pitch frequency of said sound signal and the fundamental pitch frequency of said reference sound signal, and means for providing said control signal based on the ratio of the respective fundamental pitch frequencies as detected.

5. A sound signal processing apparatus in accordance with claim 1, wherein said first filter means comprises frequency region splitting filter means for splitting said sound signal into different frequency regions, said first clock pulse generating means comprises means for generating sampling pulses associated with said respective frequency regions, said second clock pulse generating means comprises means for generating read clock pulses associated with said respective frequency regions, said frequency converting means comprises a plurality of means responsive to said respective sampling pulses for sampling the respective sound signals for the respective frequency regions as split by means of said frequency splitting filter means or storing the sampled data and for reading said sampled data responsive to said read clock pulses, and said second filter means comprises a plurality of means for receiving said read sampled data for exhibiting the respective attenuation characteristics changeable in association with the conversion of the respective read clock pulses.

* * * * *